United States Patent [19]

Birat et al.

[11] 4,178,979

[45] Dec. 18, 1979

[54] METHOD OF AND APPARATUS FOR ELECTROMAGNETIC MIXING OF METAL DURING CONTINUOUS CASTING

[75] Inventors: Jean-Pierre Birat, Algrange; Roger Ventavoli, Metz, both of France

[73] Assignee: Institut de Recherches de la Siderurgie Francaise, Saint-Germain-en-Laye, France

[21] Appl. No.: 815,416

[22] Filed: Jul. 13, 1977

[30] Foreign Application Priority Data

Jul. 13, 1976 [FR] France ..... 76 21577

[51] Int. Cl.[2] ..... B22D 11/10; B22D 27/02

[52] U.S. Cl. ..... 164/49; 164/147; 164/250

[58] Field of Search ..... 164/49, 146, 147, 250, 164/251

[56] References Cited

U.S. PATENT DOCUMENTS

| | | | |
|---|---|---|---|
| 3,693,697 | 9/1972 | Tzavaras | 164/147 X |
| 3,804,147 | 4/1974 | Babel et al. | 164/147 X |
| 3,882,923 | 5/1975 | Alberny et al. | 164/49 X |
| 3,941,183 | 3/1976 | Vedda et al. | 164/251 X |
| 3,995,678 | 12/1976 | Zavaras et al. | 164/147 X |
| 4,014,379 | 3/1977 | Getselev | 164/49 X |
| 4,042,007 | 8/1977 | Zavaras et al. | 164/147 X |

FOREIGN PATENT DOCUMENTS

| | | | |
|---|---|---|---|
| 2187465 | 8/1976 | France | 164/147 |

*Primary Examiner*—Robert D. Baldwin
*Assistant Examiner*—Gus T. Hampilos
*Attorney, Agent, or Firm*—Michael J. Striker

[57] ABSTRACT

A molten metal is poured into the upper end of a vertically tubular continuous-casting mold and is withdrawn as a hardened casting from the lower end of the mold. An electromagnetic field is displaced upwardly counter-current to the descending metal so as to mix the molten part of the metal and displace non-magnetic inclusions away from the hardening skin of the metal. The mold is operated in accordance with the following formula:

$$B^2 \times L = (1/\gamma v)(16d^2 + 120d)$$

wherein B equals effective strength of magnetic field in tesla, L equals overall vertical length of field in meters, $\gamma$ equals electrical conductivity of metal being cast in $ohms^{-1} \times meter^{-1}$, v equals vertical travel speed of field in meters/second, and d equals desired surface depth of non-metallic inclusions in millimeters i.e., the distance from the outer surface of the casting in a direction normal to this surface. As a rule the overall length L is varied to space the non-metallic inclusions the desired depth below the surface of the thus-produced casting.

10 Claims, 2 Drawing Figures

METHOD OF AND APPARATUS FOR ELECTROMAGNETIC MIXING OF METAL DURING CONTINUOUS CASTING

CROSS-REFERENCE TO RELATED APPLICATIONS

This application is related to our commonly assigned and jointly filed application Ser. No. 815,417 as well as to commonly assigned patent applications Ser. Nos. 723,194 now U.S. Pat. No. 4,042,008; 723,647 now U.S. Pat. No. 4,040,467 and 763,971, now U.S. Pat. No. 4,067,378 all of whose disclosures are herewith fully incorporated by reference.

BACKGROUND OF THE INVENTION

The present invention relates to a method of and apparatus for the continuous casting of a metal. More particularly this invention concerns the electromagnetic mixing of a metal as it is continuously cast.

In a continuous casting operation such as described in the above-mentioned copending applications as well as in French patent applications Ser. Nos. 72/20544 now French Pat. No. 2,187,465 and 76/15178 filed 5, 19, 1976, and U.S. Pat. No. 3,941,183, all of whose teachings are also herewith incorporated by reference, a metal is poured in molten condition into the top of a vertically tubular mold. This mold is cooled so that at least the outer portion of the descending column of a metal in the mold is hardened. Thus a hard casting exits continuously from the bottom of the mold. In such arrangements it has been found extremely advantageous to electromagnetically mix the molten metal, normally steel, in the mold.

Such mixing is achieved by forming a relatively powerful magnetic field and causing it to travel vertically along the mold countercurrent to the descending metal. Since the molten metal is normally introduced into the top of the mold by a so-called dip tube at the center of the mold, the molten metal in the mold forms an inverting toroid that descends in the center of the mold and rises along the periphery. Such mixing is extremely advantageous in that it not only speeds the hardening of the metal by increasing the circulation and heat dissipation in the mass and between the mass and the mold, but it also brings impurities that would form inclusions to the surface of the mold where many oxidize and are lost, or where they even can be caught in a thin slag-like layer on top of the column of descending molten metal in the mold. Such electromagnetic mixing eliminates the necessity of flame scarfing which can waste as much as 4% of the casting.

Nonetheless the known methods, although they do considerably reduce the overall quantity of inclusions and do tend to distribute these non-metallic inclusions more toward the center of the casting, do not give reliably even results. Furthermore the known methods do not allow for an adjustment of the subsurface depth of the non-metallic inclusions.

SUMMARY OF THE INVENTION

It is therefore an object of the present invention to provide an improved method of and apparatus for continuous casting.

Another object is to provide an improved electromagnetic mixing method and arrangement for use in a continuous-casting system which allows the exact establishment of the subsurface depth of the non-metallic inclusions in the casting.

These objects are attained according to the present invention in a continuous-casting method carried out substantially in accordance with the following formula:

$$B^2 \times L = (1/\gamma v)(16d^2 + 120d)$$

wherein B equals effective strength of magnetic field in tesla, L equals overall vertical length of field in meters, $\gamma$ equals electrical conductivity of metal being cast in $\text{ohms}^{-1} \times \text{meter}^{-1}$, v equals vertical travel speed of field in meters/second, and d equals desired subsurface depth of non-metallic inclusions in millimeters. Only numerical values are to be given weight in this and the following equations; once the parameters are set in the proper units such units are to be disregarded.

According to further features of this invention the establishment of the preselected subsurface depth for the non-metallic inclusions is determined mainly by varying the length L over which the magnetic field is effective on the molten metal in the mold. This is achieved by adding or subtracting coils from the coil stack at the mold which serves for the electromagnetic mixing. The lowermost coils can either by physically removed or simply electrically disconnected in order to shorten the length and extra coils can be bolted on or connected up in order to increase the length.

To this end in accordance with yet further features of this invention the coil that serves for electromagnetic mixing is constituted as a fixed upper stack of coils received in a first housing through which a coolant, normally water, is circulated for hardening the column of descending molten metal, and a second lower stack of coils below this upper stack and removable or disconnectable in the manner described above.

When the above-described molding apparatus is used for the production of rods or the like of relatively small cross-sectional size, the coils are all annular and completely surround the descending column of molten metal. When, however, a slab or relatively large billet or the like is to be produced having an elongated cross-sectional shape, each of the coils is formed as a pair of coil parts that are elongated in the direction of elongation of the mold cross-section and flank the mold. Thus the major faces of the billet will be subjected to electromagnetic mixing as described above whereas the edge surfaces will not. In such an arrangement the lower coils may be provided inside of the rollers that directly contact the wide faces of the slab and pull it from the lower end of the molds.

Thus in accordance with the present invention it is possible exactly to control the depth at which the non-metallic inclusions will lie. Normally these inclusions lie immediately beneath the surface or even at the surface of the casting, so that they greatly interfere with subsequent rolling and similar operations. With the system according to the present invention, however, it is possible exactly and without experimentation to establish the subsurface depth of these non-metallic inclusions.

It is possible to regulate the effective intensity (B) of the field simply by varying the wattage or current flowing through the inductor. The effective length (L) of the inductor is regulated as described above by either disconnecting some of the coils or physically shortening the inductor altogether. It is essential that the magnetic field not start at a level lower than that where the casting is completely solid. Furthermore it should not extend higher than the upper surface of the liquid in the mold. In this context it is noted that it is not possible to determine exactly where the liquid mass or crater inside the body being cast terminates. Normally the liquid metal extends down well below the mold, however. For this reason the upper end of the field is normally placed directly at the upper surface in the mold in order to insure that the lower end of the field does not extend past the crater of the body.

It is also, of course, possible to adjust the depth by maintaining the field strength and length the same and varying the speed (v) at which the field is moved upwardly countercurrent to the descending column of metal. This is done by changing the frequency (N) in herz of the electricity energizing the conductor. Thus the speed is directly proportional to twice the frequency multiplied by the spacing ($\tau$) between regions of opposite polarity along the inductor, or:

$$v=2\tau N$$

Since the walls of the mold are typically formed of an electrically conductive material, normally copper or an alloy of copper, the electromagnetic field passing through these walls is weakened disproportionately as its frequency increases. Thus for a given mold there is a maximum frequency beyond which the field strength drops off so greatly that this maximum frequency in effect constitutes the upper limit of the energization frequency. Thus the travel or propagation speed is normally considered to be a parameter that is fixed at a predetermined value corresponding to the optimal frequency for the energization current.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
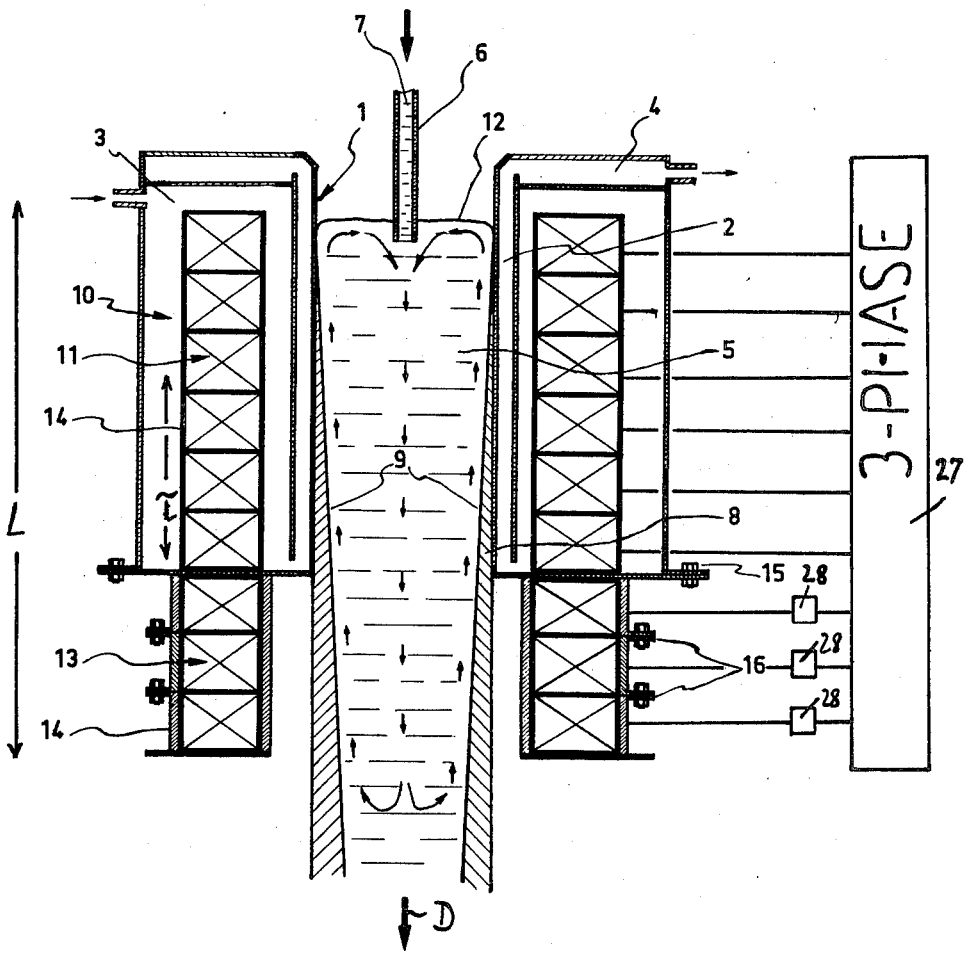
FIGS. 1 and 2 are vertical sections through mold arrangements according to this invention.

As shown in FIG. 1 a mold according to this invention basically comprises an upwardly open mold tube 1 surrounded by a housing defining an annular cooling chamber 2 surrounding the inner wall of the mold tube 1 and having an inlet chamber 3 and an outlet chamber 4 for vertical circulation of cold water along the outer wall of the mold tube 1.

Liquid metal is introduced into the top of the mold 1 through the passage 7 of a dip tube 6 whose lower end lies below the upper surface 12 of the crater 5 formed by the liquid metal. Since the walls of the mold 1 are cooled a hard skin of increasing thickness is formed around this crater 5 and the interface between them is shown at 9.

An inductor 10 formed of a fixed upper part 11 and an adjustable lower part 13 is constituted as a stack of nine like coils 14, six in the upper part 11 and three in the lower part 13. All of these coils 14 are connected to an alternating-current power supply 27. The lower coils 14 are connected via openable switches 28 to the power supply 27 so that the effective length L of the inductor 10 can be reduced. The power supply 27 energizes the coils 14 sequentially in such a manner that the field effectively travels upwardly at a velocity v equal to twice the frequency N of the power supply multiplied by the spacing $\tau$ between adjacent coils 14 of like polarity.

The overall length L can be changed by disconnecting some of the coils 14 of the lower stack 13 by opening of the switches 28, or by unbolting the coils 14 of the lower stack 13 from each other at bolt connections 16 or from the upper stack 11 at bolt connections 15.

Thus as the metal is introduced in molten form into the mold via the dip tube 6 it will harden on the outer portion 8, but the crater 5 inside this outer portion 8 will form an inverting toroid, descending in the center and rising along the edges. This will automatically bring to the surface non-metallic inclusions where they can either remain in a slag-like layer or oxidize. The casting is continuously drawn off downwardly in the direction D indicated by the arrow in FIG. 1 at such a rate that the upper level 12 remains generally level with the upper end of the inductor 10. Since the skin 8 increases in thickness downwardly eventually the magnetic field of the inductor 10 is not sufficient to mix the molten metal 5 through the relatively thick skin 8. At this time the inclusions will become trapped at the interface 9.

The arrangement of FIG. 1 is used for making relatively small-diameter rods and the like and the coils 14 are all annular and completely surround the mold 1. Removal of the lower stack 13 sets the lower limit on the length L, and corresponds to a subsurface depth of inclusions equal to between 1 and 10 mm.

Figure 2:
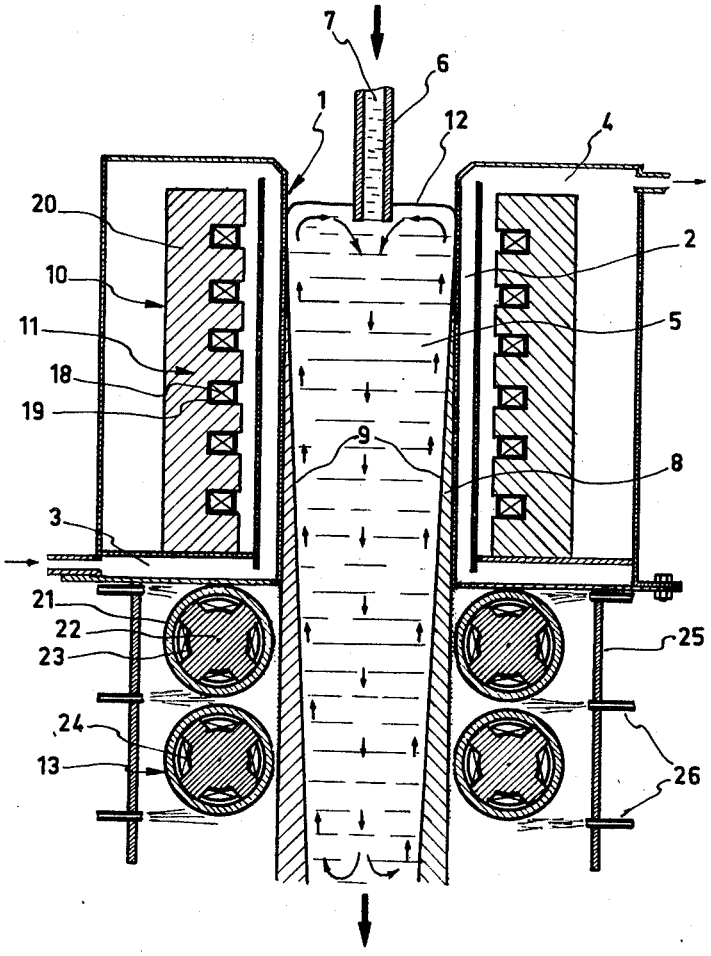

When slabs or the like of larger dimensions are to be continuously cast a system such as shown in FIG. 2 where like reference numerals are used where like structure is employed. In the arrangement of FIG. 2 the body being continuously cast is elongated horizontally in a direction perpendicular to the plane of the view.

Here, the inductor 10 is formed as described in the above-cited U.S. patent application Ser. No. 723,194 now U.S. Pat. No. 4,042,008 whose entire disclosure, as mentioned above, is hereby fully incorporated by reference. Thus in this arrangement the upper inductor 10 is formed as a pair of stacks of soft-iron plates forming straight parallel notches 19 in which are received respective coil parts 18. The two sides of the upper inductor 11 are mirror-symmetrical about a vertical plane passing through the center of the mold and here, once again, perpendicular to the plane of the view and extending in the direction D. Thus the upper inductor 11 is formed of two like parts each extending parallel to the respective side of the mold 1.

The lower inductor 13 here is formed of rollers 21 in which are received cruciform-shaped plates forming horizontal stacks 22 receiving coils 23. A housing 25 provided with spraying nozzles 26 is provided surrounding the rollers 21 housing the magnets 22, 23 for cooling them and cooling the casting descending downwardly from the mold 1. In this arrangement it has been found that by appropriate angular spacing of the coils 23 in the rollers 21 and of the coils 18 in the upper inductor 11 it is possible to achieve a completely uniform electromagnetic mixing. The rotation rate of the rollers 21 and the coils 23 with them determines the advance speed for the lower inductor 13 whereas that for the upper inductor 11 is simply determined by the frequency and spacing as described with reference to FIG. 1.

EXAMPLE

The arrangement of FIG. 1 is employed to make steel billets of square-section measuring 120 mm on a side. The continuous billet is withdrawn downwardly in direction D at a velocity v of 2 m/minute. Thus the thickness of the skin 8 at the lower end of the mold 1 is approximately 12 mm.

The inductor 10 is fed with three-phase current and the various coils 14 are connected to a common phase on one side and connected together in series-opposition. Two consecutive coils connected to the same phase are separated by two other coils each connected to a respective one of the other phases of the current from the power supply 27. The coils have a polar spacing $\tau$ of 0.24 m. The coils are so wired that they can be energized at 350 A without heating excessively. This creates an electrical field having a strength of 0.042 tesla in the casting being formed immediately inside the interface 9. The frequency N of the energization current is fixed at 10 Hz which for the mold in question is the optimum value.

In order to space all of the non-magnetic inclusions approximately 8 mm below the surface of the billet being formed it is necessary to adjust the arrangement so that $$B^2L=6.6\times10^{-4}\ \text{Tesla}^2\times m$$

The electrical conductivity $\gamma$ of the steel is equal to $$6.25\times10^{-5}\Omega^{-1}m^{-1}$$

Removing the lower part 13 of the inductor altogether gives the arrangement an effective length L equal to twice the spacing $\tau$ between coils of like polarity or 0.48 m.

Thus for these calculations it is necessary to have an effective field of 0.037 tesla. Thus in the arrangement wherein the effective magnetic field strength is 0.042 tesla and the inductor has an overall length of 0.48 the inclusions will be at least 8 mm deep.

Subsequently the same test was provided but with the three coils 14 of the lower stack 13 connected to the power supply 27 so that the overall length L was increased by one increment $\tau$. According to the calculations it would only be necessary to use a field strength of 0.030 tesla to achieve the same results as given above, that is pushing the inclusions at least 8 mm beneath the surface of the billet. In reality it was found that it was necessary to use a field strength of 0.034 tesla. Since, however, this is within approximately 10% of the calculated result the formula proves true.

The invention described above can be used in any type of continuous-casting of a metal. In accordance with this invention it is possible therefore to position the non-metallic inclusions at the desired depth below the surface in a sure and accurate manner. Thus a later working of the continuously made castings is substantially eased, in particular when laminating or otherwise operating directly on the surface of such castings.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of continuously casting a metal having a conductivity $\gamma$ in 1/ohm-meter comprising the steps of:

continuously pouring said metal in molten condition into the top of a vertically tubular mold to form therein a descending column of said metal;

continuously cooling said mold to harden the periphery of said column;

continuously displacing a magnetic field having an effective strength B in tesla and a vertical length L in meters vertically upwardly in said mold at a propagation velocity v in meters per second to mix said metal in said mold;

establishing a desired subsurface depth d in millimeters of inclusions in the metal in said mold by setting the numerical values of the parameters B, L, $\gamma$, and v in accordance with the formula $B^2\times L=(1/\gamma v)(16d^2+120d)$; and continuously withdrawing a cooled casting from the bottom of said mold.

2. The method defined in claim 1, wherein said field is formed by a stack of coils, said depth d being established by varying said length L by changing the number of coils in said stack.

3. An apparatus for the continuous casting of metal having an electrical conductivity of $\gamma$ in 1/ohm-meter, said apparatus comprising a vertically oriented continuous casting mold; a housing surrounding said mold and defining with the latter a cooling chamber; means associated with said mold for pouring metal into said mold, whereby said metal moves through said mold as a descending column; means for cooling said mold to form a solidified shell at the periphery of said descending column; mixing means including an upper stack of coils in said cooling chamber and a lower stack of coils positioned below said mold for providing an electric field having an effective strength B in tesla and a combined length L in meters and for displacing said field vertically upwardly in said mold at a propagation speed V in meters per second, said magnetic field acting on the molten metal in the vicinity of said shell in vertical upward direction while the molten metal remote from the shell moves in vertical downward direction; a power supply permanently connected to said upper stack of coils; and adjusting means operatively connected with said lower stack of coils and said power supply for selectively connecting said power supply to said coils of said lower stack of coils to vary the combined vertical length for establishing a desired surface depth d in millimeters for inclusions in said descending column according to the numerical values resulting from the formula $B^2\times L=(1/\gamma v)(16d^2+120d)$.

4. The mold apparatus defined in claim 3, wherein said adjustment means includes means associated with each coil of said lower stack for detaching each coils of said lower stack from the other coils of said lower stack.

5. The mold apparatus defined in claim 3, wherein said coils are annular.

6. The mold apparatus defined in claim 3, wherein said mold defines a mold cavity elongated horizontally in a predetermined direction, said coils each including a pair of coil parts each elongated in said direction and the parts of each coil being parallel and spaced apart to opposite sides of said mold transverse to said direction.

7. The mold apparatus as defined in claim 6, including a plurality of withdrawal rollers below said mold to opposite sides of the casting, said lower coils being arranged in th interior of said rollers.

8. The mold apparatus as defined in claim 7, and including a further housing surrounding said rollers, and a plurality of nozzles mounted in said housing for spraying a cooling fluid onto said rollers and the casting passing therebetween.

9. The mold apparatus defined in claim 3, wherein said power supply is an alternating-current power supply.

10. The mold apparatus as defined in claim 3, wherein the coils of the stack of upper coils abut against each other and the coils of the stack of lower coils abut against each other and are separated from the stack of upper coils only by a wall portion of said cooling chamber.

* * * * *